US005295809A

United States Patent [19]

Dresler et al.

[11] Patent Number: 5,295,809

[45] Date of Patent: Mar. 22, 1994

[54] VALVED PISTON PUMP WITH CYLINDER BIASING MEANS

[75] Inventors: Helmut Dresler, Trostberg; Ernst Turnwald, Altenmarkt, both of Fed. Rep. of Germany

[73] Assignee: Linde Aktiengesellschaft, Wiesbaden, Fed. Rep. of Germany

[21] Appl. No.: 978,961

[22] Filed: Nov. 23, 1992

[30] Foreign Application Priority Data

Nov. 21, 1991 [DE] Fed. Rep. of Germany ..... 4138174

[51] Int. Cl.[5] ..... F01B 11/02

[52] U.S. Cl. ..... 417/366; 417/569; 92/117 R; 92/169.1

[58] Field of Search ..... 417/457, 460, 467, 552, 417/569, 901, 366; 92/66, 117 R, 169.1

[56] References Cited

U.S. PATENT DOCUMENTS

| | | | |
|---|---|---|---|
| 2,090,688 | 8/1937 | Lindberg | 417/569 |
| 2,199,452 | 5/1940 | Voss | 417/569 |
| 3,490,683 | 1/1970 | Kocher | 417/569 |
| 3,910,729 | 10/1975 | Jepsen et al. | 92/66 |
| 4,146,355 | 3/1979 | Bröker et al. | 417/457 |
| 4,239,460 | 12/1980 | Golz | 417/901 |
| 4,388,051 | 6/1983 | Dresler et al. | 417/505 |

*Primary Examiner*—Richard A. Bertsch
*Assistant Examiner*—Roland G. McAndrews, Jr.
*Attorney, Agent, or Firm*—Millen, White, Zelano, & Branigan

[57] ABSTRACT

A piston pump for conveying a fluid includes a cylinder which is not flanged to the pump casing, but rather is inserted in the pump casing and is retained in the longitudinal direction by a pretensioned spring. A seal is arranged between the cylinder jacket and the pump casing in order to seal the pressure side with respect to the suction side of the piston pump. An extremely compact piston pump results therefrom, suitable, in particular, for use in the low-temperature range due to very low cold losses.

15 Claims, 1 Drawing Sheet

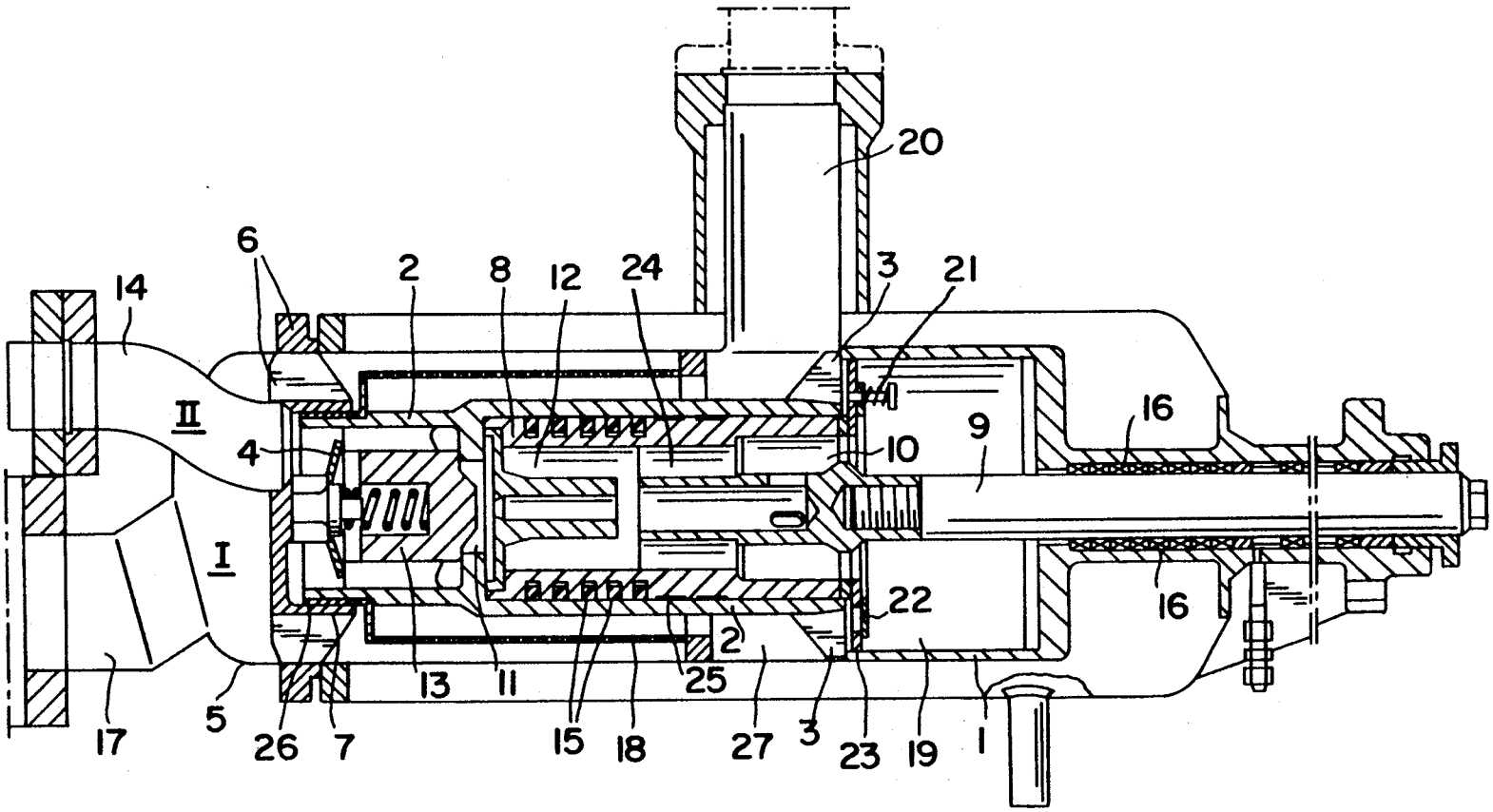
16
16
9
21
20
3
10
22
1
19
23
3
27
2
25
24
18
12
15
8
11
2
13
7
6
4
26
5
II
I
14
17

VALVED PISTON PUMP WITH CYLINDER BIASING MEANS

BACKGROUND OF THE INVENTION

The invention relates to a piston pump for conveying a fluid, with a cylinder arranged in a pump casing, a piston being displaceable therein in the longitudinal direction, one end of the cylinder being associated with a pressure side of the piston pump and the other end of the cylinder being associated with a suction side of the piston pump.

In all piston pumps, the cylinder has heretofore been fixedly threaded to the pump casing by means of a flange in order to absorb the reactive forces occurring during operation of the piston pump. The flanging requires a large casing diameter, resulting in high costs for material and labor. When used in the low-temperature range, there is the additional drawback that cooling of the resulting large masses takes considerable time and generates considerable costs for the operator on account of evaporation of conveying fluid.

SUMMARY OF THE INVENTION

Therefore, it is an objeot of the present invention to provide a compact piston pump for the conveyance of a or heated.

Upon further study of the specification and appended claims, further objects and advantages of this invention will become apparent to those skilled in the art.

This object has been attained according to this invention by supporting the cylinder in the longitudinal direction with respect to the pump casing, stressing the cylinder with a pretensioned spring in the direction toward the support, and sealing the pressure side with respect to the suction side.

The cylinder is thus restrained in the longitudinal direction with the aid of the pretensioned spring. When the cylinder is in contact with the pump casing, the above-described arrangement is already sufficient for holding the cylinder without movement in its predetermined position. Otherwise, at least one spacer element for centering the cylinder is disposed between the cylinder jacket and the pump casing.

In conventional piston pumps, the flanging of the cylinder to the pump casing is used for separating the pressure and suction sides of the piston pump. Since no flanging is provided in the piston pump according to this invention, the pressure and suction sides must be separated from one another in some other way. This is achieved by a seal arranged suitably between the cylinder jacket and the pump casing. Advantageously, a lip seal of PTFE (polytetrafluorathylene) is located for this purpose between the cylinder jacket and the pump casing, preferably in the region of the spacer element.

The cylinder is suitably simply inserted with one end in the pump casing so that the end rests on the pump casing. At the other end, a cup spring is preferably arranged which stresses the cylinder in the longitudinal direction so that the cylinder is urged with the opposite end against the pump casing.

In this arrangement, the spring force is dimensioned so that reaction forces acting on the cylinder during operation of the piston pump are safely absorbed.

According to an especially preferred embodiment of the invention, provision is made for subdividing the inner space of the cylinder by the piston into a high-pressure chamber and a low-pressure chamber with a volume larger than the high-pressure chamber. The piston head has a spring-loaded suction valve. Fluid precompressed in the low-pressure chamber can pass via this valve into the high-pressure chamber. A spring-loaded pressure valve is located in the high-pressure chamber; via this valve, the fluid brought to operating pressure can be discharged to possible consumers. The spring force of the spring retaining the cylinder in the longitudinal direction is dimensioned so that the piston friction and the opening resistance of the pressure valve are absorbed.

Moreover, the portion of the high-pressure chamber located, as seen from the suction valve, behind the pressure valve, exhibits preferably an equally large or larger diameter as the piston. As a result, the cylinder is urged with a higher force in the longitudinal direction against the pump casing than the relief force acting on the cylinder by the pressure stroke of the piston. This achieves the result that the cylinder always remains in its pre-determined position, independently of the conveying pressure.

Since no flanging needs to be included in the piston pump according to this invention, it is possible to save considerable costs in labor and material, especially in case of relatively large pumps. The assembly and disassembly of the pump are simplified since the cylinder can be easily installed or dismounted, respectively, by insertion or removal of the spring. Based on the small masses required for the fixation of the cylinder and the small contact surfaces between cylinder and pump casing, cooling of the pump when used in the low-temperature range takes a much shorter period of time than in case of conventional pumps. Also, less conveying liquid evaporates due to the lower heat buildup so that the costs for the operator can be markedly lowered.

It is possible by this invention to provide an extremely compact piston pump which can be built with a small casing diameter even with large piston diameters. By integration of the pressure valve in the high-pressure zone of the cylinder, the compact structure of the piston pump is additionally enhanced. Besides, it is furthermore possible to install a filter in space-saving fashion between the pump casing and the cylinder wall to subject the fluid to be conveyed to a preliminary cleaning step.

The piston pump according to this invention is suitable for transporting of fluids of all types, such as, for example, oil, fuel, hot gas, cold gas, or liquid gas. This piston pump displays its advantages quite especially in the conveying of low-temperature liquefied gases, such as helium, nitrogen, oxygen or hydrogen. In this area, the low refrigeration losses and the compact structure of the piston pump according to this invention exert a particularly positive effect.

BRIEF DESCRIPTION OF THE DRAWINGS

The invention will be described in greater detail below with reference to an embodiment shown schematically in the FIGURE which shows a two-stage, low-temperature pump in the longitudinal sectional view.

DETAILED DESCRIPTION

The cylinder 2 is inserted in the pump casing 1 in such a way that a first end of the cylinder end is in contact with the pump casing by means of supporting surfaces 3. A second end of the cylinder 2 is engaged by a pretensioned cup spring 4 supported by cap mountings 6 on a casing cap 5 attached to the pump casing 1 to stress or bias the cylinder 2 in the longitudinal direction. Consequently, the cylinder is urged with the supporting surfaces 3 against the pump casing 1 and is held in the longitudinal direction. The cylinder 2 is centered in the region of the casing cap 5 by a spacer ring 7 disposed between the cylinder 2 and the pump casing 1.

A piston 8 is arranged in the cylinder 2 to be displaceable in the longitudinal direction. A piston rod 9 for driving the piston 8 is mounted to the piston 8. The piston 8 subdivides the cylinder interior into a low-pressure chamber 10 and a high-pressure chamber 11.

The high-pressure chamber 11, associated with the pressure side or outlet II of the piston pump, is sealed by means of a lip seal 26 of the PTFE located between the cylinder jacket 2 and the pump casing 1 with respect to the suction side or inlet I, i.e., for example, with respect to the fluid to be pumped, fed from a storage tank via the feed conduit 17. A spring-loaded suction valve 12 is mounted to the piston head; fluid, precompressed in a charging chamber 19, passes via this valve into the high-pressure chamber 11. In the high-pressure chamber 11, a spring-loaded pressure valve 13 is arranged, by which the fluid brought to the operating pressure is delivered to a discharge conduit 14.

Sealing of the piston 8 within the cylinder 2 is provided by sealing piston rings 15 of a low-wear PTFE mixture. Guide rings 25 are made of the same material; these rings center the piston. The cylinder 2 is made of stainless steel; the operating surface is hard and extremely finely machined.

The pressure-maintaining valves 13 and 12 are spring-loaded; the piston 8 and the piston rod 9 are threaded together. The sealing of this piston rod 9, the surface of which is hard and extremely finely machined, is provided by several cap gaskets 16 having a special shape and made of a PTFE mixture. In order to improve the sealing effect, a slotted clamping ring of the same material with a coil spring is placed over the conical part of the cap gaskets 16.

The mode of operation of the piston pump is as follows:

The conveying medium flows through a lower horizontal pipe connection 17 via the filter 18 into a suction chamber 27 as well as a charging chamber 19 and cools the pump. The thus-produced gas escapes through a vertical pipe stub 20. After adequate precooling of the pump, taking place within a short period of time in view of the small mass, the pump can be placed on stream.

Owing to the piston movement, the fluid flows with low losses through a charging member 23, provided with a valve plate 22 stressed by a spring 21, into the charging chamber 19. Upon stroke reversal, the fluid is conveyed through piston bores 24 by way of the spring-loaded suction valve 12 into the high-pressure chamber 11.

Since the volume of the charging chamber 19 is a multiple of the high-pressure volume 11, a pressure increase of the conveying medium occurs. This rise in pressure reliably prevents evaporation of the conveying fluid, which latter is mostly in the boiling condition, and thus ensures an optimum, gas-free filling of the high-pressure chamber 11 whereby the delivery rate is substantially increased as compared with conventional pumps.

The diameters of charging member 23 and charging chamber 19 are dimensioned so that the charging pressure necessary in this process in correspondence with the number of strokes is set without friction, i.e., at a low number of strokes, the pressure drop in the gap between the charging chamber 19 and the charging number 23 is smaller than in case of a high number strokes.

The fluid, compressed in the high-pressure chamber 1 to operating pressure, opens the pressure valve 13 and passes via the discharge conduit 14 to a possible consumer.

The entire disclosures of all applications, patents and publications, cited above and below, and of corresponding application German P 41 38 174.2, filed November 21, 1991, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A piston pump for conveying a fluid includes a cylinder arranged in a pump casing and a piston displaceable within the cyclinder in the longitudinal direction, one end of the cylinder being associated with a pressure side and the other end of the cylinder being associated with a suction side of the piston pump, wherein the cylinder (2) is supported by a support (3) in the longitudinal direction with respect to the pump casing (1) and is urged with a pretensioned spring (4) in the direction of the support (3), wherein the pressure side (II) is sealed with respect to the suction side (I), and wherein at least one spacer element (7) for centering the cylinder (1) is disposed between the cylinder (2) and the pump casing (1).

2. The piston pump according to claim 1 wherein the lip seal (26) is made of PTFE (polytetrafluorathylene).

3. The piston pump according to claim 1, wherein the cylinder (2) is inserted with one end in the pump casing (1), and the pretensioned spring (4) is a pretensioned cup spring arranged at the other end to stress the cylinder (2) in the longitudinal direction.

4. The piston pump according to claim 1, wherein the spring force of the pretensioned spring (4) is dimensioned so that reactive forces acting on the cylinder (2) during operation of the piston pump are absorbed.

5. The piston pump according to claim 1, wherein the cylinder interior is subdivided by the piston (8) into a high-pressure chamber (11) and a low-pressure chamber (10) having a volume that is larger as compared with that of the high-pressure chamber, wherein the piston includes piston head having a spring-loaded suction valve (12); wherein a spring-loaded pressure valve (13) is positioned in the high-pressure chamber (11), and wherein the spring force of the spring (4) is selected so that piston friction and opening resistance of the pressure valve (13) are absorbed.

6. The piston pump according to claim 1, wherein a lip seal (26) for sealing the pressure side (II) against the suction side (I) is disposed between the cylinder (2) and the pump casing (1).

7. The piston pump according to claim 6, wherein the lip seal (26) is made of PTFE (polytetrafluoracthylene).

8. The piston pump according to claim 7, wherein the cylinder (2) is inserted at one end in the pump casing (1), and the pretensioned spring (4) is pretensioned cup spring arranged at the other end to stress the cylinder (2) in its longitudinal direction.

9. The piston pump according to claim 8, wherein the spring force of the pretensioned spring (4) is dimensioned so that reactive forces acting on the cylinder (2) during operation of the piston pump are absorbed.

10. The piston pump according to claim 9, wherein the cylinder interior is subdivided by the piston (8) into a high-pressure chamber (11) and a low-pressure chamber (10) having a volume that is larger as compared with that of the high-pressure chamber, wherein the piston includes piston head having a spring-loaded suction valve (12); wherein a spring-loaded pressure valve (13) is positioned in the high-pressure chamber (11), and wherein the spring force of the pretensioned spring (4) is selected so that piston friction and opening resistance of the pressure valve (13) are absorbed.

11. The piston pump according to claim 10, wherein the high-pressure chamber (11) has a portion disposed behind the pressure valve (13) in relation to the suction valve (12) and has a diameter at least substantially as large as that the piston (8).

12. A piston pump arrangement configured to minimize mass while maintaining both cooling capacity as it conveys a fluid and structural integrity with a pump casing, the piston pump arrangement, comprising:

a cylinder having a first end and a first chamber from which fluid to be pressurized is sucked, the cylinder having a second end and a second chamber in which the fluid is pressurized;

a piston disposed within the cylinder, the piston having a pressure face; a suction face and a one-way valve communication one face with another, the piston moving in a first direction for pressurization and a second direction for suction and generating reaction forces on the cylinder as it reciprocates;

means for reciprocating the piston in a longitudinal direction;

an outlet valve disposed proximate the second end of the cylinder, the outlet valve being biased toward the pressure face of the piston and opening upon the pressure of the fluid reaching a preselected level;

an outlet connected to the cylinder upstream of the outlet valve for receiving the pressurized fluid;

an inlet in communication with the suction face of the piston for supplying the fluid to be pressurized;

means proximate the first end of the cylinder for supporting the first end of the cylinder on the pump casing;

means proximate the second end of the cylinder for supporting the second end of the cylinder on the pump casing; and means fixed to the pump casing and engaging the cylinder for biasing the second end of the cylinder against the pump casing, said biasing means applying a resilient force in opposition to the first direction in which the piston moves so as to absorb reaction forces acting on the cylinder.

13. The piston pump of claim 12, wherein between the cylinder and pump casing there is a space through which the fluid to be pressured flows whereby the piston pump is cooled by the fluid to be pressurized.

14. The piston pump of claim 13, wherein the biasing means is a spring member.

15. This piston pump of claim 14, wherein a seal is disposed between the second end of the cylinder and the pump casing.

* * * * *